US007633012B2

(12) United States Patent
Yeh

(10) Patent No.: US 7,633,012 B2
(45) Date of Patent: Dec. 15, 2009

(54) STRUCTURE FOR FLEXIBLE FLAT CABLE

(75) Inventor: Shih-Kun Yeh, Taoyuan Hsieh (TW)

(73) Assignee: Tennrich International Corp. (TW)

( * ) Notice: Subject to any disclaimer, the term of this patent is extended or adjusted under 35 U.S.C. 154(b) by 15 days.

(21) Appl. No.: 12/076,595

(22) Filed: Mar. 20, 2008

(65) Prior Publication Data

US 2009/0236122 A1 Sep. 24, 2009

(51) Int. Cl.
*H01B 7/00* (2006.01)

(52) U.S. Cl. ..... 174/110 R; 174/117 R; 174/117 F

(58) Field of Classification Search ..... 174/110 R, 174/113 R, 117 R, 117 F
See application file for complete search history.

(56) References Cited

U.S. PATENT DOCUMENTS 2,361,374 A * 10/1944 Abbott ..... 174/117 F
3,082,292 A * 3/1963 Gore ..... 174/117 F
4,218,581 A * 8/1980 Suzuki ..... 174/117 F
4,475,006 A * 10/1984 Olyphant, Jr. ..... 174/36
4,490,574 A * 12/1984 Tomita et al. ..... 174/36
5,206,462 A * 4/1993 Iura et al. ..... 174/117 F
5,327,513 A * 7/1994 Nguyen et al. ..... 385/114
5,428,189 A * 6/1995 Dorner et al. ..... 174/117 F
2002/0062979 A1 * 5/2002 Murakami et al. ..... 174/117 F

* cited by examiner

*Primary Examiner*—William H Mayo, III
(74) *Attorney, Agent, or Firm*—Jackson IPG PLLC

(57) ABSTRACT

The main body of the flexible flat cable of the invention includes a particular quantity of cores and sheath layers. The core includes a plurality of single conductor wires or a plurality of twisted conductor wires compressively combined by top and bottom sheath layers located above and below the core to form a flexible flat cable main body.

4 Claims, 6 Drawing Sheets

STRUCTURE FOR FLEXIBLE FLAT CABLE

BACKGROUND OF THE INVENTION (a) Field of the Invention

The invention is related to a main body of flexible flat cable with better transmission efficiency.

(b) Description of the Prior Art

As electronic products become more and more delicate, so are the structures of computers and electrical machines, flat cables are used in said signal transmission situations to allow for rapid electric connectors assembly operations, while it is through the flat cable design of arrangement type structure to maintain internal layouts of computers and electrical machine in tidiness for easy heat dissipation or easy maintenance thereby to further maintain a good transmission effect.

Referring to FIG. 1 and FIG. 2 for the known flat cable structure, said flat cable 1 comprises a top glue layer 11, a bottom glue layer 12 and a plurality of single conductor wires 13, wherein one side of said top glue layer 11 and one side of said bottom glue layer 12 are smeared with glues, thereby two or more than two single conductor wires 13 are parallel attached on to the glue surface of bottom glue layer 12, and said top glue layer 11 covers on each single conductor wire 13 and top of said bottom glue layer 12 to allow said single conductor wire 13 to adhere between said top glue layer 11 and bottom glue layer 12, thereby to constitute an externally enclosed flat cable structure.

However, the known flat cable structure basically has the following problems: In practical use, unavoidably, each of the plurality of the parallel arranged single conductor wires 13 which constitute flat cable structure 1 may have to be branched, or bended and formed in various directions in order to mutually insertingly connect with corresponding connectors, thereby further to cause the overall structure of said flat cable 1 to be stripped apart, wherein. In addition, the transmission efficiency of said overall flat cable structure is poorer.

SUMMARY OF THE INVENTION

The purpose of the invention is to disclose a flexible flat cable main body with better transmission efficiency.

To achieve the above purpose, main body of the flexible flat cable of the invention comprises a particular quantity of cores and sheath layers, wherein said core including a plurality of single conductor wires or a plurality of twisted conductor wires is compressively combined by top and bottom sheath layers on above side and underside thereof to form a flexible flat cable main body with better transmission efficiency.

DETAIL DESCRIPTION OF THE PREFERRED EMBODIMENTS

Figure 1:
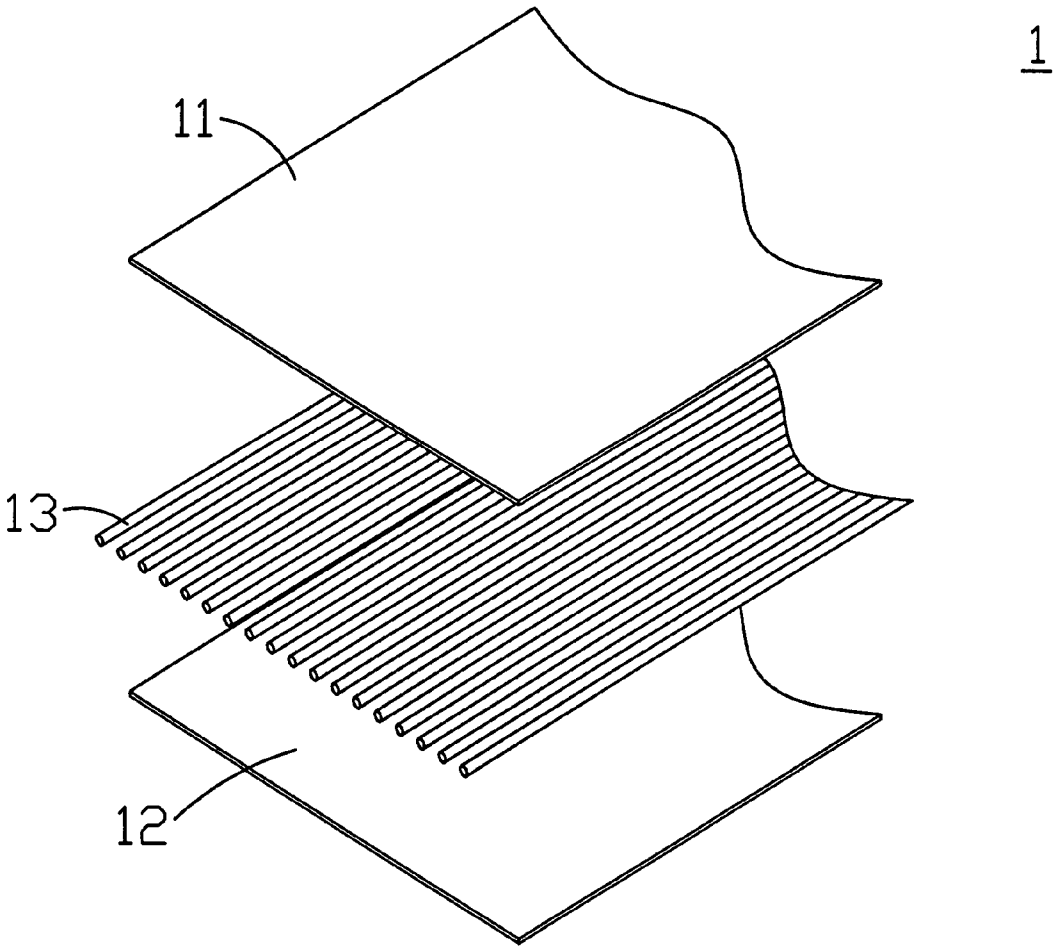
FIG.1 PRIOR ART
FIG. 1 is a perspective decomposition view of a known flat cable.
Figure 2:
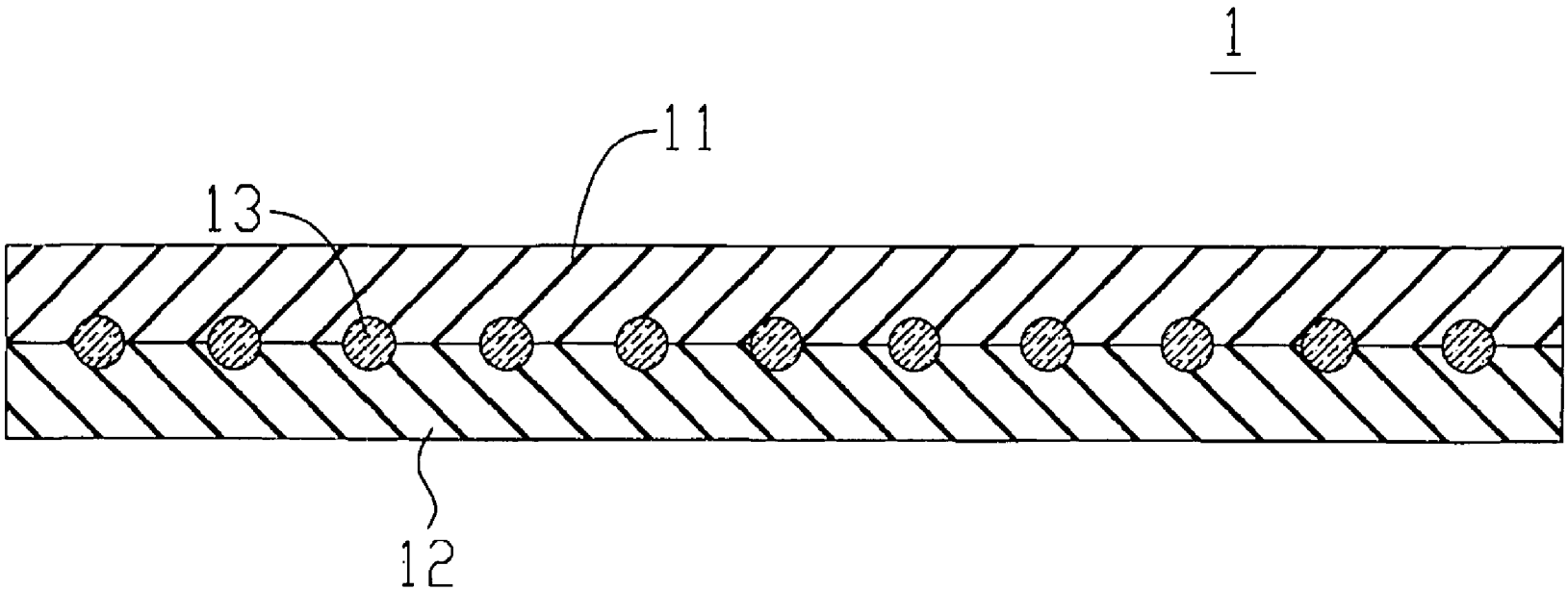
FIG. 2 PRIOR ART
FIG. 2 is a structural cross-sectional view of a known flat cable.
Figure 3:
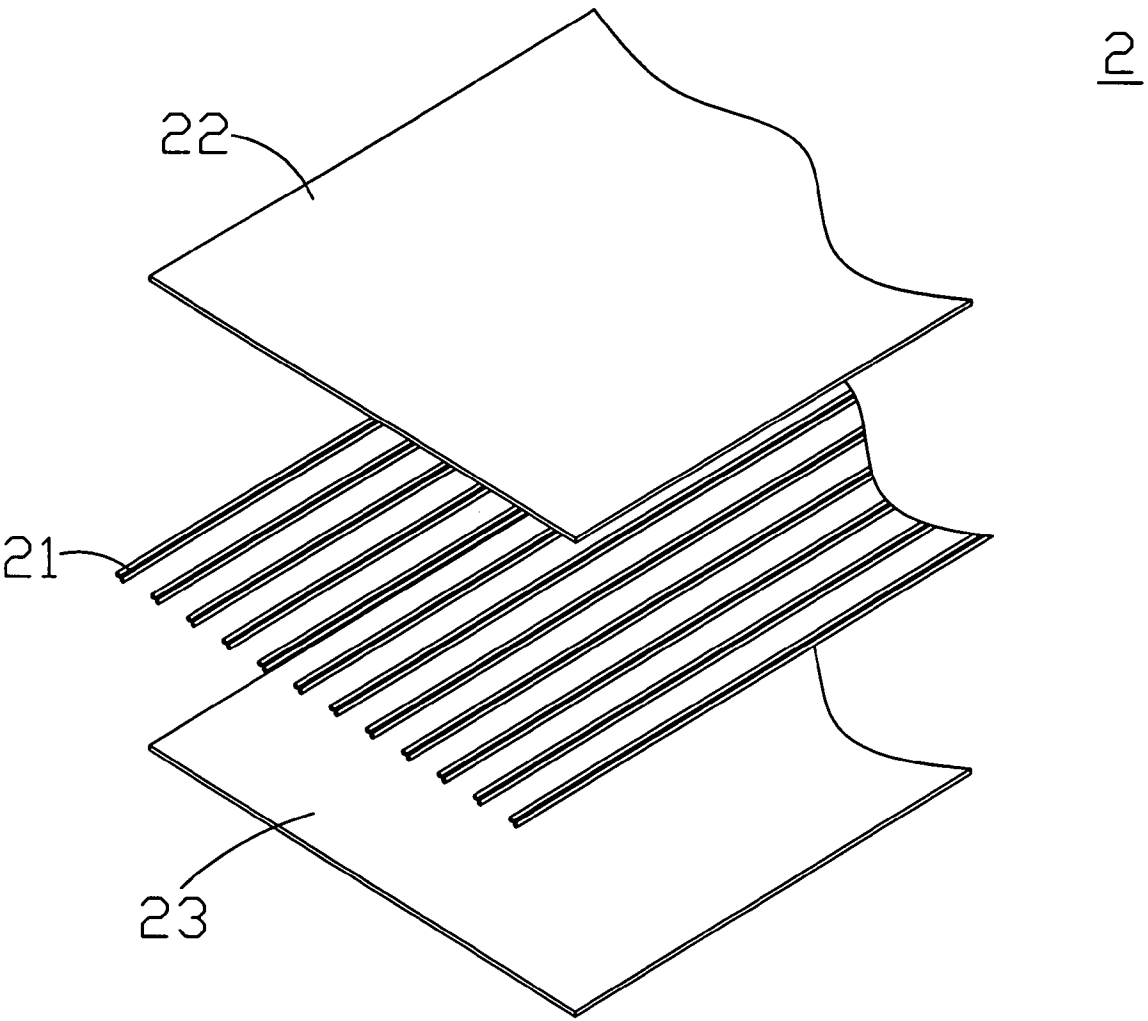
FIG. 3 is a structural perspective decomposition view of the flexible flat cable of the invention.

The "improved structure for flexible flat cable" is to disclose a main body of flexible flat cable with better transmission efficiency, wherein as shown in FIG. 3, said flexible flat cable 2 is compressively combined by a particular quantity of cores 21, top and bottom sheath layer 22, 23, etc.

Figure 4:
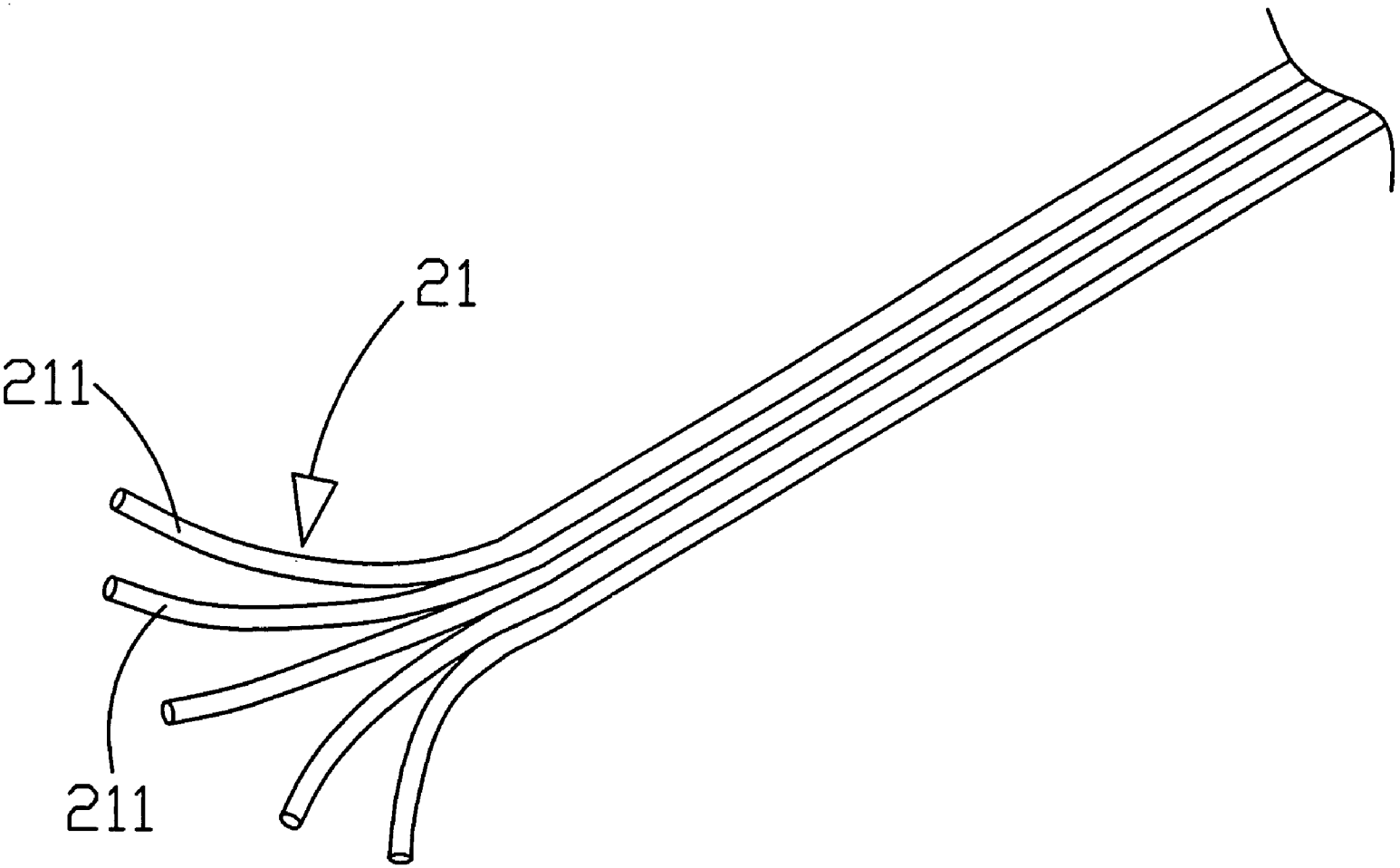
FIG. 4 is a structural perspective view showing the core structure in the first embodiment of the invention.
Figure 5:
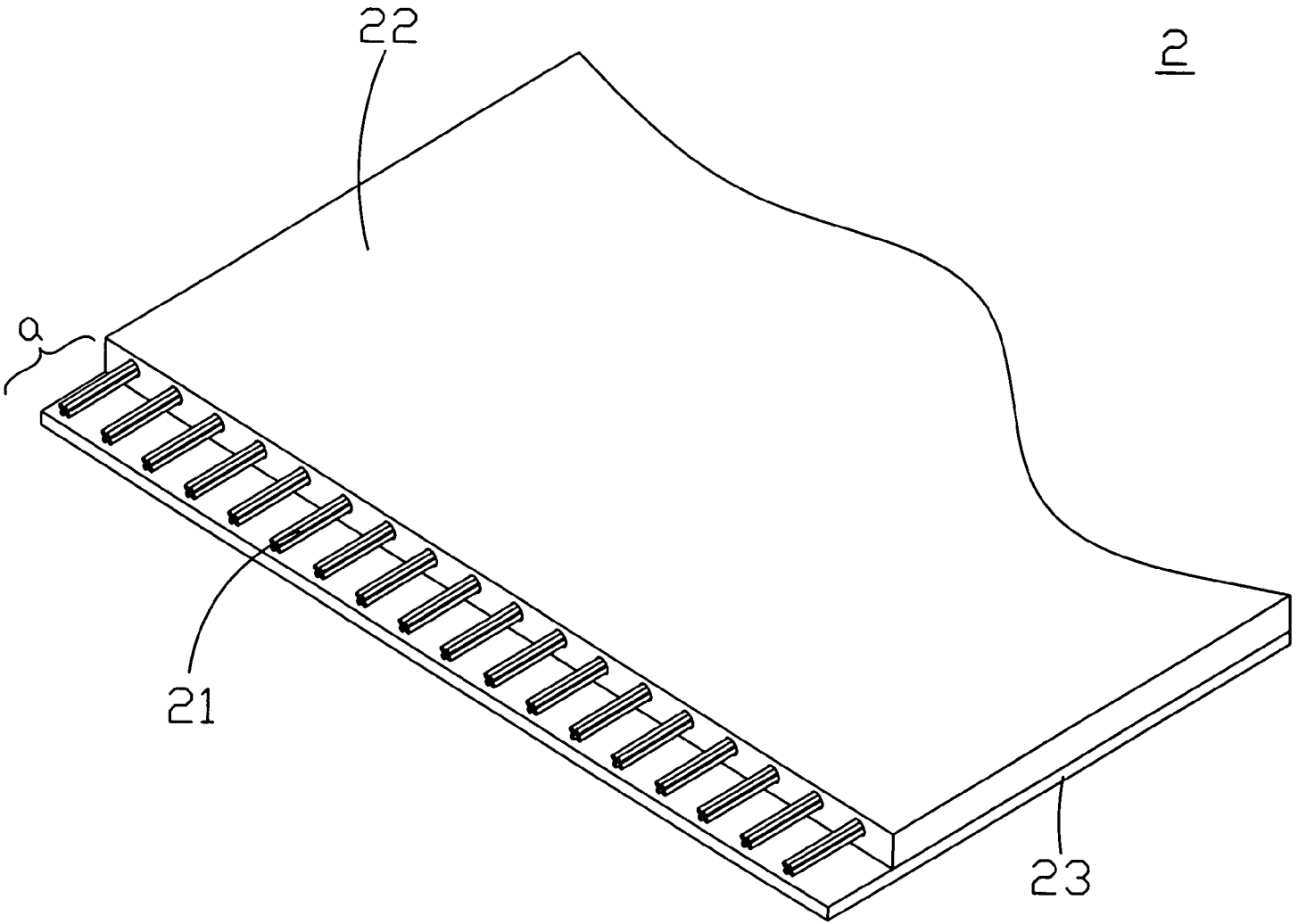
FIG. 5 is a structural perspective view of the flexible flat cable of the invention.

Referring to the first embodiment as shown in FIG. 4 simultaneously, said core 21 includes a plurality of single conductor wires 211, said top and bottom sheath layers 22, 23 allow front end portion of each core 21 to expose thereby forming a connecting part a, and said top and bottom sheath layers 22, 23 are made of insulator material thereby to further form a complete flexible flat cable structure 2 as simultaneously shown in FIG. 3 and FIG. 5.

Figure 6:
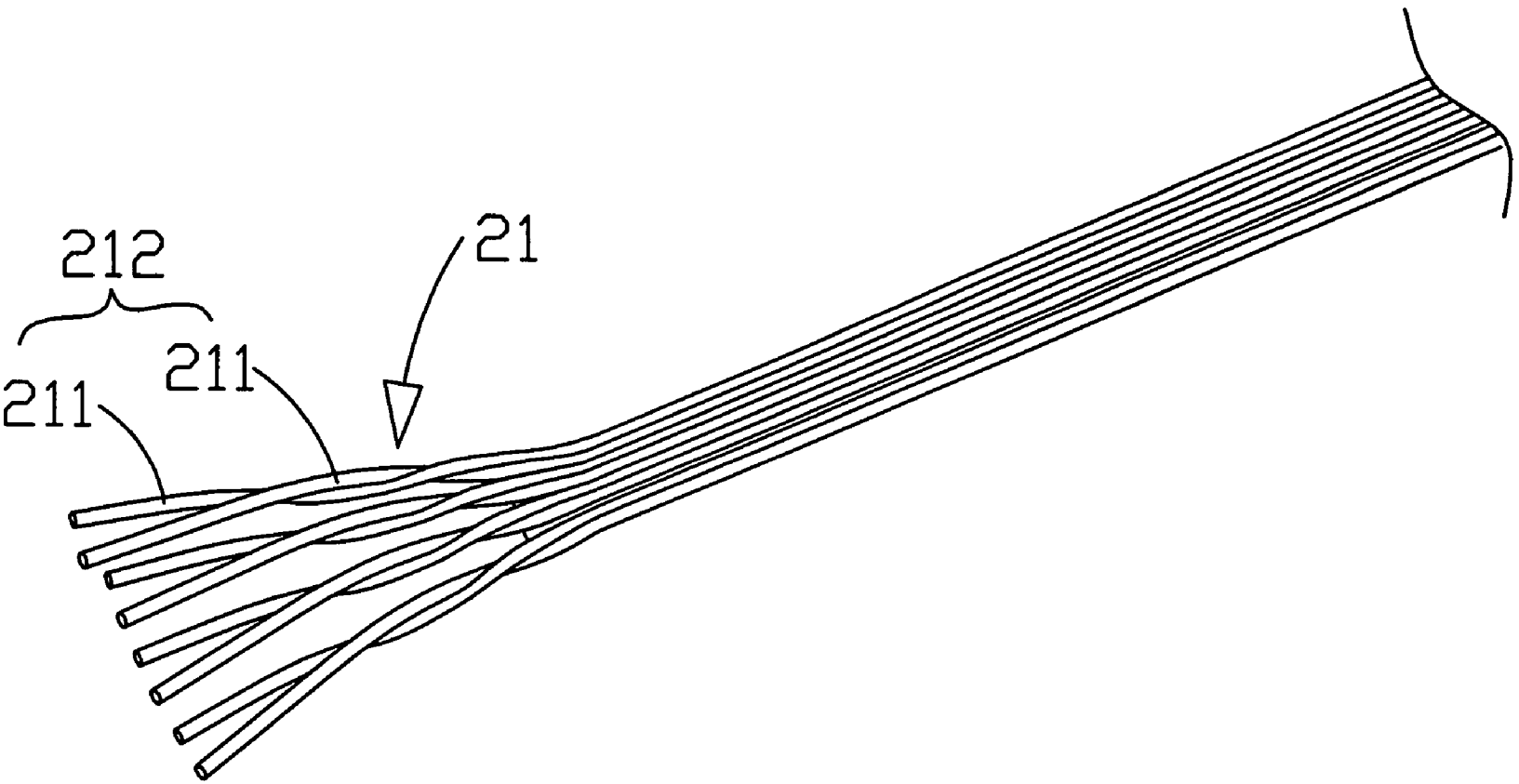
FIG. 6 is a structural perspective view showing the core structure in the second embodiment of the invention.

In addition, as shown by the second embodiment in FIG. 6, said core 21 comprises a plurality of twisted conductor wires 212, said twisted conductor wire 212 whereof includes at least two or more mutually twisted single conductor wires 211 as shown in the Fig., wherein said top and bottom sheath layers 22, 23 are compressively combined on above side and underside of each core 21, and allow front end portion of each core 21 to expose thereby forming a connector part a, thereby to further form a complete flexible flat cable structure 2 as simultaneously shown in FIGS. 3 and 5.

It is worthy to mention that the invented core including a plurality of single conductor wires or a plurality of twisted conductor wires improves the imperfection of the known one comprising only a single conductor wire, and the said flexible flat cable of the invention has a better transmission efficiency.

The contents and characteristics of the invented art is disclosed as described above, while substitution or modification without deviation from the spirit of the invention may be made by those skilled in the art based on disclosure of the invention. Nevertheless, the disclosed embodiments shall not limit the claimed scope of the invention but shall include all substitutions and modifications without deviation from the invention and shall all be covered by the scope of claims herein.

I claim:

1. An improved structure for flexible flat cable, wherein said flexible cable is compressively combined by a particular quantity of cores, and top and bottom sheath layers; said top and bottom sheath layers are compressively combined above and below each core, and said top and bottom sheath layers are made of insulator material, wherein the improvement is:

said core includes a plurality of single parallel conductor wires.

2. The improved structure for flexible flat cable as claimed in claim 1, wherein said top and bottom sheath layers allow front end portion of each core to expose thereby forming a connector part.

3. An improved structure for flexible flat cable, wherein said flexible flat cable is compressively combined by a particular quantity of cores, and top and bottom sheath layer; said top and bottom sheath layers allow front end portion of each core to expose thereby forming a connecting part, and said top and bottom sheath layers are made of insulator material, wherein the improvement is:

said core includes a plurality of parallel conductors, with each conductor being formed by at least two twisted conductor wires.

4. The improved structure for flexible flat cable as claimed in claim 3, wherein said top and bottom sheath layers allow front end area of each core to expose thereby forming a connector part.

* * * * *